United States Patent [19]

Chivato

[11] Patent Number: 4,787,341

[45] Date of Patent: Nov. 29, 1988

[54] PRESSURE ASSIST PISTON FOR INTERNAL COMBUSTION ENGINE

[76] Inventor: Eleuterio E. Chivato, Residencia las Alamedas No. 3-5 II, Laredo (Cantabria), Spain

[21] Appl. No.: 853,641

[22] Filed: Apr. 18, 1986

[30] Foreign Application Priority Data

May 21, 1985 [ES] Spain ..... 543340

[51] Int. Cl.[4] ..... F02B 75/04

[52] U.S. Cl. ..... 123/48 D; 123/78 D

[58] Field of Search ..... 123/48 R, 48 A, 48 AA, 123/78 R, 78 A, 78 AA, 78 D, 48 D

[56] References Cited

U.S. PATENT DOCUMENTS

| | | | |
|---|---|---|---|
| 922,613 | 5/1909 | McClintock | 123/78 AA |
| 2,215,986 | 9/1940 | Stevens | 123/78 AA |
| 2,414,217 | 1/1947 | Weiss et al. | 123/78 AA |
| 2,419,450 | 4/1947 | Howard | 123/78 AA |
| 2,914,047 | 11/1959 | Colton | 123/48 AA |

*Primary Examiner*—Charles J. Myhre
*Assistant Examiner*—David A. Okonsky
*Attorney, Agent, or Firm*—Ostrolenk, Faber, Gerb & Soffen

[57] ABSTRACT

A controlled pressure combustion chamber for a reciprocating engine. The engine includes a main cylinder and a main reciprocating piston. In the cyliner head is a second cylinder which opens to the first cylinder. A free piston in the second cylinder in shiftable in the second cylinder to absorb energy upon displacement of the main piston in the main cylinder due to compression and combustion. A pneumatic cushion is defined behind the free piston in its second cylinder and pressure in the pneumatic cushion adjusts displacement of the free piston. The free piston includes a projection which abuts an abutment in the second cylinder and motion of the free piston is damped. Valves in the second cylinder maintain the desired pressure in the pneumatic cushion.

8 Claims, 1 Drawing Sheet

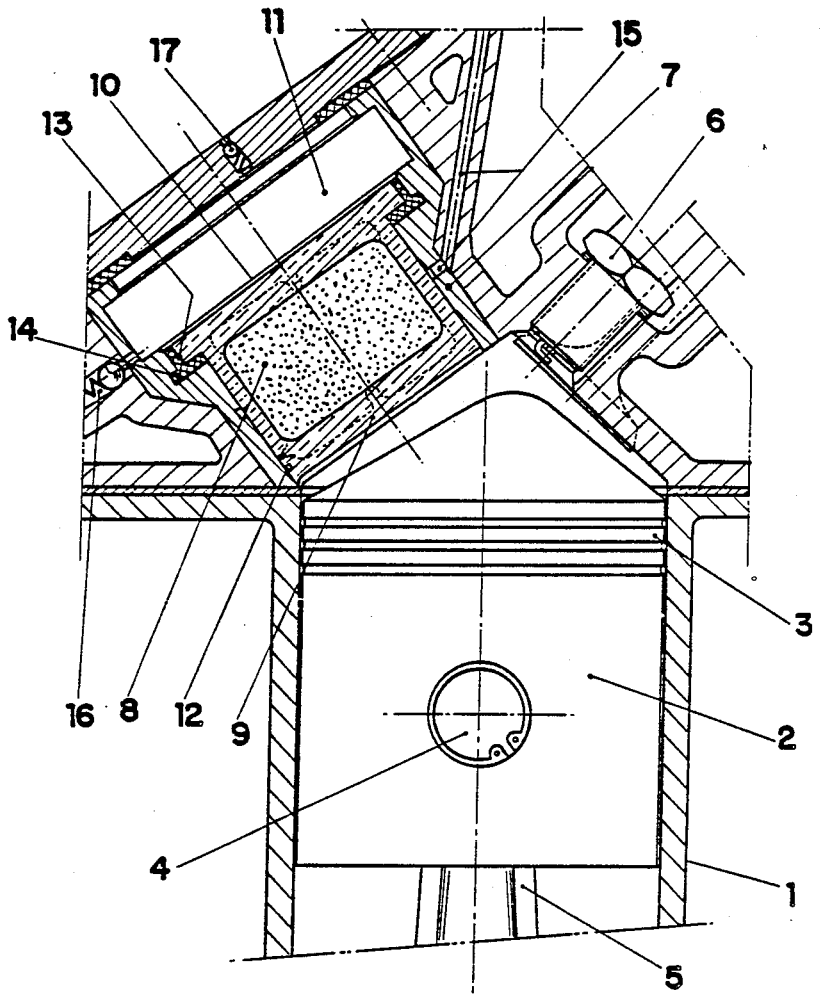
11
17
10
13
15
7
6
14
3
16
8
12
9
2
4
1
5

PRESSURE ASSIST PISTON FOR INTERNAL COMBUSTION ENGINE

BACKGROUND OF THE INVENTION

The present invention relates to combustion chambers of reciprocating internal combustion engines which use any type of fuel.

The main drawbacks presented by engines of this type include:

(a) poor efficiency;

(b) necessity of employing additives in the most refined fuels in order to adapt them to the essential characteristics of the engine. Aside from the fact that the fuels are more expensive, this results subsequently in the exhaust gases being more contaminating.

SUMMARY OF THE INVENTION

The object of the present invention is to provide a new chamber in an internal combustion engine which makes it possible to eliminate the above-mentioned drawbacks.

In the cylinder head of the engine, a separate cylinder is provided which connects the compression and combustion chamber to a pneumatic chamber in the separate cylinder. A free piston is arranged in the separate cylinder between the separate cylinder and the pneumatic chamber. Its purpose is to delay and prolong the combustion and to absorb energy during the compression and combustion and then to release the energy during the expansion.

For high-speed gasoline and diesel engines, the free piston must be of the lightest material possible in view of the influence of its weight on the rapidity of response. The piston must also have the greatest possible thermal conductivity and resistance to mechanical stresses. It must have the necessary piston rings and grooves suitable for the perfect distribution of the lubricating oil.

At its end facing away from the combustion chamber, the free piston has a projection whose purpose is to limit its displacement. To dampen the impact of this projection against the frame or cylinder bottom, a rubber ring is provided. The thickness and hardness of the ring or washer has a substantial effect on the commencement of the displacement of the free piston due to the state of the equilibrium of forces with the pressure of the pneumatic cushion.

The rubber washer of the projection is capable of providing sufficient tightness so that the pressure in the chamber of the pneumatic cushion is maintained with the engine stopped. The slight flow of gases which may take place between the compression and cushion chambers during the operation of the engine must be in the direction from the compression to the cushion chambers. As a result, the pressure of the cushion increases. In order to prevent the increase in pressure from affecting the displacement of the free piston or from completely preventing it, a suitably calibrated valve maintains the pressure at the value set.

If lubricating oil passes to the pneumatic cushion chamber, this will also affect the pressure in that chamber, and it will also be expelled through the valve. In this case, the free piston must be provided with suitable protection in order to prevent the oil from depositing within it. In the latter case, the piston would be made tight by plugging it at its upper part, filling it with a gas which is a good conductor of heat.

It has been found that with the use of the same pneumatic cushion volume and pressure in a gasoline engine, the volume yielded was excessive for speeds of 1500 and 3000 rpm, while it was rather less for 5000 rpm.

Accordingly, 4000 rpm should not be exceeded since above this speed the efficiency of the engine is reduced by the energy wasted, primarily in the movement of the reciprocating masses.

By limiting the maximum speeds to 4000 rpm and accepting a reduction in the benefit from the free piston for speeds of from 0 to 2500 rpm, there is an operating range from 2500 to 4000 rpm, which can be covered with good efficiency without varying the volume or pressure of the pneumatic cushion.

To obtain maximum efficiency for a wider range of speeds of revolution of the engine, it is necessary to vary the volume or the pressure of the pneumatic cushion. In the former case, it is necessary to attach a mechanism which varies the volume of the pneumatic cushion, and in the latter case, a compressor varies the pressure of the pneumatic cushion.

Nevertheless, for low speeds, it is always necessary to limit the stroke of the free piston by some device, a metal or plastic spring, etc. The most effective method is for the upper part of the free piston to fit itself in a cylindrical hollow, without air outlet, when its backward movement might be excessive.

With the modification of reciprocating internal combustion engines in accordance with the present invention, there are obtained, by increase of the torque, increases in actual power on the order of 20% to 30%, while retaining the same cylinder displacement, rpm and consumption of fuel.

In automobile engines of high rpm, it would be more desirable in using the invention, to reduce the operating speed in the proportion indicated. While retaining the same cylinder displacement and power, the fuel consumption would be reduced approximately in the same proportion of 20% to 30%.

In accordance with the invention, higher compression ratios will be used, so that combustion will start at a higher pressure than in ordinary engines. Further, this will be maintained during the development of the combustion within a predetermined value, which has the following advantages:

In gasoline engines, it permits the use of fuels of a lower octane number, that is to say cheaper gasolines without additives. To a great extent, this eliminates contamination of the exhaust gases.

In diesel engines, it similarly influences the oetane number, preventing high peaks of combustion pressure, reducing the characteristic knocking of this type of engine and facilitating its cold starting.

While retaining the same cylinder displacement of the engine and reducing the rpm in the proportion indicated, the life of the engine will be increased by approximately 30%.

Under the conditions set forth in the preceding item, the consumption of lubricating oil would be reduced by 20% to 25%. Although the free piston will also consume oil, it carries out only one cycle for every two cycles of the engine piston, and its path is approximately 15% to 20% of the stroke of the engine.

It will substantially improve the cold-starting of the engine, since the starting will take place with a higher compression ratio and therefore a higher compression pressure and temperature.

Due to the higher compression values, the engine will better retard the vehicle when it is no longer accelerating.

The thermal cycle is improved by a decrease in the heat of dissociation of the gases in the combustion since this will reach lower temperatures due to the combustion taking place at a constant pressure during the major part of the cycle. Due to the lower temperatures, the losses by heat will be less and the damage to the parts of the combustion chamber, valves, injector plugs, etc. will also be less.

Due to the limiting of the maximum combustion pressures, the instantaneous stresses on all the parts of the engine, piston, pins, bearings, connecting rod, etc., will be less. In some cases, this will make it possible to reduce their strength and weight, particularly in diesel engines, in which a large reduction in the operating vibration and noise can also be foreseen.

In high-speed diesel engines, swirl chambers, air accumulation chambers and combustion antechambers will no longer be necessary since the volume yielded by the free piston will have a similar effect, creating the necessary flows within the combustion chamber.

Similarly, in all diesel engines the fuel-injection will be simplified since, in addition to the flows in the chamber, the combustion will be substantially prolonged. This will permit the use of injectors with larger outlet orifices and a small number of orifices.

BRIEF DESCRIPTION OF THE DRAWING

For a better understanding of the present invention a detailed description is given below of the accompanying drawing, which shows a combustion chamber in accordance with the invention.

DESCRIPTION OF A PREFERRED EMBODIMENT

The drawing shows a cylinder 1 of a gasoline engine. Conventional openings or passages into the cylinder 1 permit entry of the fuel mixture and exhaust of the combustion products. Within the cylinder 1 there is a reciprocating piston 2 provided with piston rings 3. The piston transmits its force through the pin 4 and the connecting rod 5. In the cylinder head, there are corresponding conventional valves, one of which is shown in dashed lines, and a spark plug 6. In the case of diesel engines, the location of the spark plug would hold the injector.

There is a second cylinder 7. Within it, there is an axially displaceable free piston 8. The front part 9 of that piston forms part of the boundary of the compression and combustion chamber of the cylinder 1, while its opposite rear face 10 is subject to the pressure of an air chamber 11 which acts like a pneumatic cushion. The piston 8 is provided with rings 12. In its rear part, that piston has a peripheral rearward projection 13 which limits its stroke. In order to avoid a hard blow between the projection and the frame, a rubber ring 14 is interposed which damps the impact. The free piston 8 is lubricated through the conduit 15.

In order to avoid an increase of the pressure in the chamber 11 due to the passage of gases from the combustion chamber, a spring-loaded valve 16 is provided which permits the escape of gases from the chamber 11 when a predetermined pressure in the chamber is exceeded. A valve 17 is also provided if the chamber 11 has to be charged with air.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A controlled pressure combustion chamber for a reciprocating engine, the engine comprising a main cylinder including means permitting admission of a fuel mixture and escape of exhaust material therefrom, means for initiating combustion of the fuel mixture in the main cylinder, a piston supported for reciprocating movement through the main cylinder, the main cylinder having a head, toward and away from which head the piston reciprocates in the cylinder;

a second cylinder in the piston head, the second cylinder opening toward the main cylinder; a free piston disposed for displacement along the second cylinder and communicating with the main cylinder for prolonging the compression and combustion stages and absorbing energy upon displacement of the first mentioned piston by the compression and combustion; the second cylinder being closed on the side of the free piston away from the main cylinder, for defining a pneumatic cushion in the second cylinder which generates a force resisting movement of the second piston away from the main cylinder, when said pneumatic cushion is compressed by movement of the second piston away from the main cylinder, said pneumatic cushion being substantially the only source of such a resisting force, whereby when the pressure in the pneumatic cushion and the pressure in the first cylinder have become equalized due to displacement of the first and second pistons, the free piston commences to return energy to the first piston in the main cylinder on the stroke thereof while the gases of combustion expand.

2. The combustion chamber of claim 1, further comprising a retainer on the free piston for retaining the free piston in the second cylinder.

3. The combustion chamber of claim 1, wherein the second cylinder includes abuttable means for being abutted by the free piston upon movement of the free piston away from the first cylinder.

4. The combustion chamber of claim 3, wherein the free piston includes a peripheral projection which abuts the abuttable means of the second cylinder after the free piston has moved a predetermined distance through the second cylinder away from the first cylinder.

5. The combustion chamber of claim 4, further comprising means disposed at the projection of the free piston for damping the impact of the free piston on the abuttable means of the second cylinder.

6. The combustion chamber of claim 3, further comprising means including an enlarged-diameter portion of the free piston for damping the impact of the free piston against the abuttable portion, said abuttable portion being a portion of the second cylinder having narrower diameter.

7. The combustion chamber of claim 1, wherein the second cylinder is closed behind the second piston for defining a pneumatic cushion behind the second piston and inside the second cylinder.

8. The combustion chamber of claim 7, further comprising valve means in the second cylinder for permitting charging of the second cylinder for defining the pneumatic cushion and for limiting the maximum pressure in the pneumatic cushion and for permitting lubricating oil to exit from the second cylinder.

* * * * *